US006098692A

United States Patent [19]

Dieckmann

[11] Patent Number: 6,098,692

[45] Date of Patent: Aug. 8, 2000

[54] AWNING HAVING BALANCED FABRIC STRETCHING

[75] Inventor: Martin Dieckmann, Mettingen, Germany

[73] Assignee: Schmitz-Werke GmbH & Co., Emsdetten, Germany

[21] Appl. No.: 09/282,466

[22] Filed: Mar. 31, 1999

[30] Foreign Application Priority Data

May 23, 1998 [DE] Germany ..... 198 23 199

[51] Int. Cl.[7] ..... E04F 10/06

[52] U.S. Cl. ..... 160/66; 160/392

[58] Field of Search ..... 160/66, 67, 68, 160/22, 52, 55, 56, 57, 58.1, 76, 392, 395, 384, 387, 385

[56] References Cited

U.S. PATENT DOCUMENTS

| | | | |
|---|---|---|---|
| 4,020,888 | 5/1977 | Upton et al. | 160/66 |
| 4,214,621 | 7/1980 | Wessels et al. | 160/66 |
| 4,690,192 | 9/1987 | Stilling et al. | 160/57 |
| 5,002,111 | 3/1991 | Boiteau | 160/67 |
| 5,718,253 | 2/1998 | McNamee | 160/67 X |

FOREIGN PATENT DOCUMENTS

| | | |
|---|---|---|
| 90 03 059 | 6/1990 | Germany . |
| 44 27 297 | 10/1995 | Germany . |

*Primary Examiner*—David M. Purol
*Attorney, Agent, or Firm*—Browdy and Neimark, PLLC

[57] ABSTRACT

In an awning, such as a joint-arm awning or winter-garden awning, including an awning fabric to be furled which is fixed in at least one piping groove on a drop-out pipe with a view to obtaining balanced stretching and avoiding the lateral seams from sagging, a deflection arrangement is disposed in vicinity to where the awning fabric is fixed, increasing or reducing the free length of the fabric.

7 Claims, 3 Drawing Sheets

AWNING HAVING BALANCED FABRIC STRETCHING

BACKGROUND OF THE INVENTION

1. Field of the Invention

The invention relates to an awning, such as a joint-arm awning or a winter-garden awning, comprising an awning fabric to be furled which is fixed by a piping in at least one piping groove on a drop-out pipe.

2. Background Art

In awnings of the generic type, in particular in winter-garden awnings, the stress ratios there prevailing occasionally lead to the outer seams sagging, which is not satisfying optically. A similar problem may occur with joint-arm awnings of increased drop-out width.

SUMMARY OF THE INVENTION

It is an object of the invention to embody an awning of the type mentioned at the outset such that balanced stretching along the outer seams can be realized without any problems.

According to the invention, this object is attained by a deflection arrangement being disposed in vicinity to where the awning fabric is fixed, increasing or reducing the free length of the fabric.

Favorably, the deflection arrangement comprises a piping groove having a piping as well as a spacer which extends radially away from the drop-out pipe between the piping groove that serves for fixing and the piping groove that serves for deflection.

In other words, a piping groove is conventionally provided for instance on the drop-out pipe for the end of the fabric there to be fixed by the aid of a piping sewn into the end of the fabric.

Before the awning fabric, seen from the fabric shaft, arrives in this piping groove that serves for fixing, it is deflected around a piping located in a piping groove which extends parallel to the piping groove that serves for fixing.

In this way it is possible to insert one or several spacers in the area between the two piping grooves, the spacers changing the effective length of the fabric by deflection, thus causing balanced stretching of the fabric and preventing any sagging of the seam.

Regardless of the feasibility of balanced stretching, the second piping groove that serves for deflection offers the additional advantage of strain relief for the piping seam provided at the end of the awning fabric in particular in the case of extreme stress ratios. The awning fabric is perforated by this piping seam, there being the risk of the fabric tearing, which is prevented by the strain relief mentioned.

Favorably the spacer is inserted between the drop-out pipe and the awning so that it is arrested by the stretched fabric, there being no need of additional fastening means.

Provision can also be made for a plurality of spacers of varying size to be available so that a suitable spacer can be selected in each individual case.

Details of the invention will become apparent from the ensuing description of a preferred exemplary embodiment, taken in conjunction with the drawing.

DESCRIPTION OF THE PREFERRED EMBODIMENT

Figure 1:
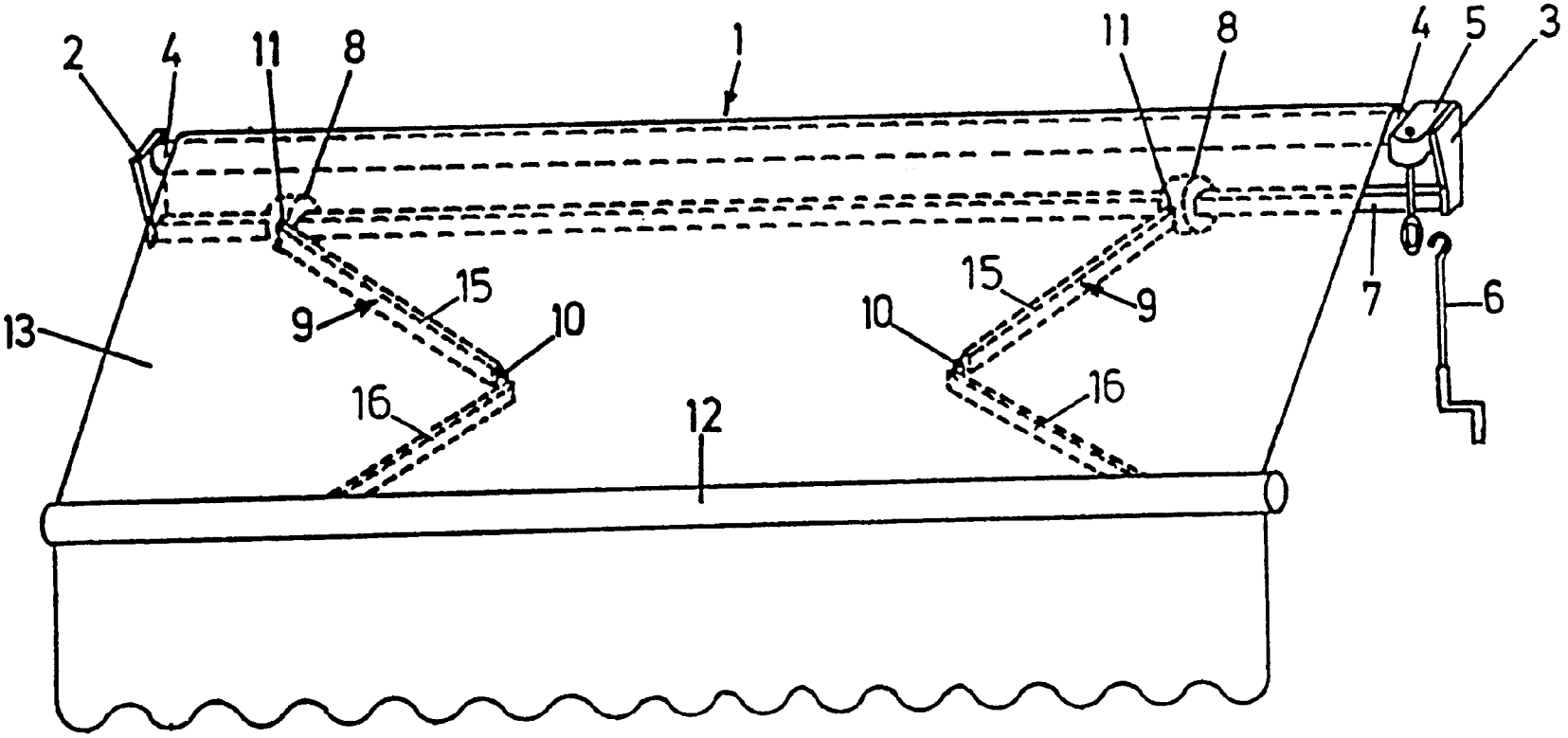
FIG. 1 is a diagrammatic illustration of a joint-arm awning.
Figure 2:
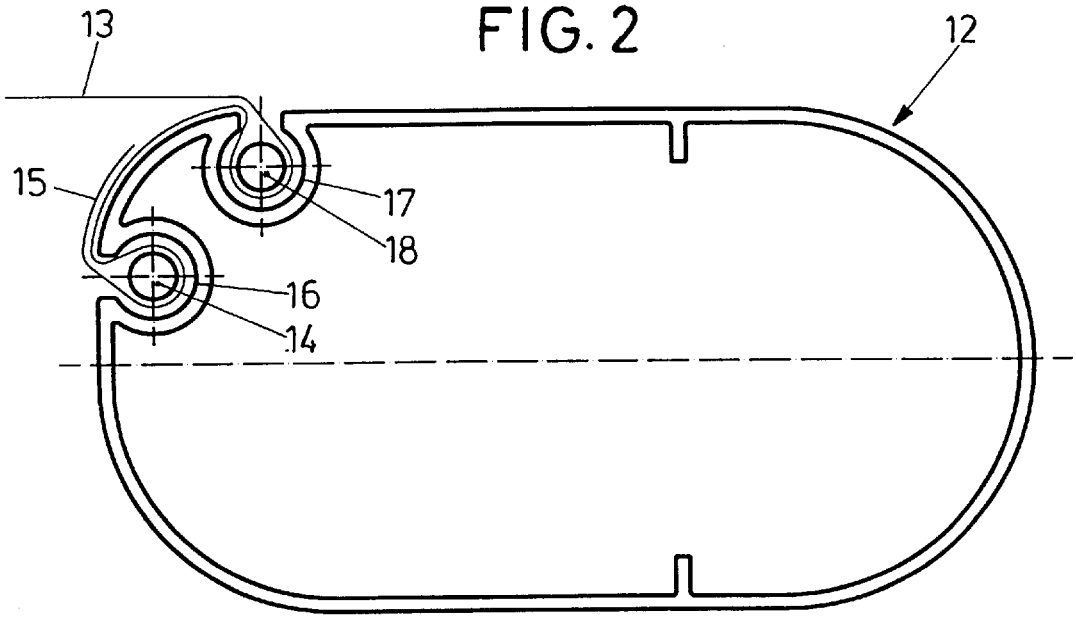
FIG. 2 is a section through the portion of the drop-out pipe without a spacer; and FIGS. 3

The awning seen in the drawing comprises a support device 1 to be attached to the wall of a house or the like and provided with a winding shaft 4 rotatably run in bearing plates 2, 3. In known manner, this winding shaft 4 can be driven to rotate, i.e. according to the illustration of FIG. 1, by means of a self-locking mechanism 5 which can be driven by a demountable hang-up rod 6. Of course, as generally known, an electric-motor drive, a belt drive or the like can be used instead of the mechanism 5 and the rod 6. As part of the support device 1, a support pipe 7 of square cross-sectional shape is installed between the bearing plates 2 and 3, joint arms 9 in the form of so-called lazy tongs being mounted on the support pipe 7, each by means of a device 8 for the support and the adjustment of the angle of inclinations. These joint arms 9 are divided centrally and provided with a pivot joint 10 having a vertical axis. Each joint arm 9 is articulated to the device 8 by a pivot joint 11 of the same kind and—which cannot be seen in the drawing—to a drop-out pipe 12 by means of a corresponding pivot joint so that the drop-out pipe 12 and the winding shaft 4 are displaceable on a common plane without being able to move vertically to this plane.

A rectangular awning fabric 13 is mounted on the winding shaft 4 which can be wound on or off the winding shaft 4 by the mentioned rotations. The awning fabric 13 is fixed to the drop-out pipe 12 in a manner generally known. A fringe is fixed to the drop-out pipe 12, hanging down from it.

A piping 14 serves for fixing the awning fabric 13 to the drop-out pipe 12; the end 15 of the awning fabric is sewn around the piping 14 and the piping 14 is inserted in a piping groove 16 that serves for fixing.

Before reaching the mentioned piping groove 16, the awning fabric 13 passes into another piping groove 17, which extends on the drop-out pipe 12 in parallel to the piping groove 16 and at a little distance therefrom. Disposed in the piping groove 17 is a piping 18, around which the fabric 13 is deflected, then arriving in the piping groove 16 that serves for fixing.

Figure 3:
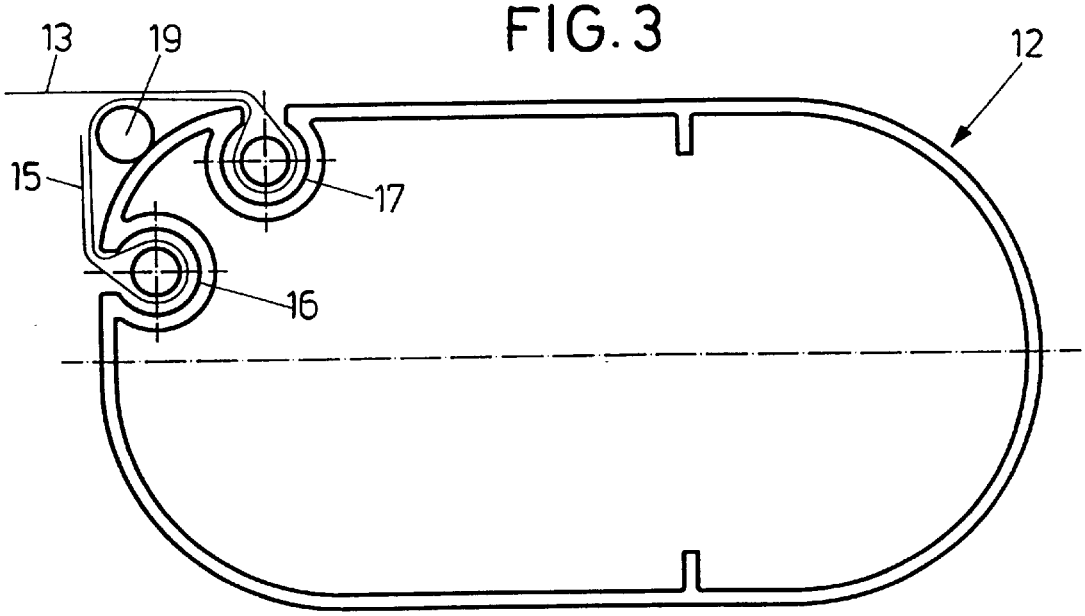
Figure 4:
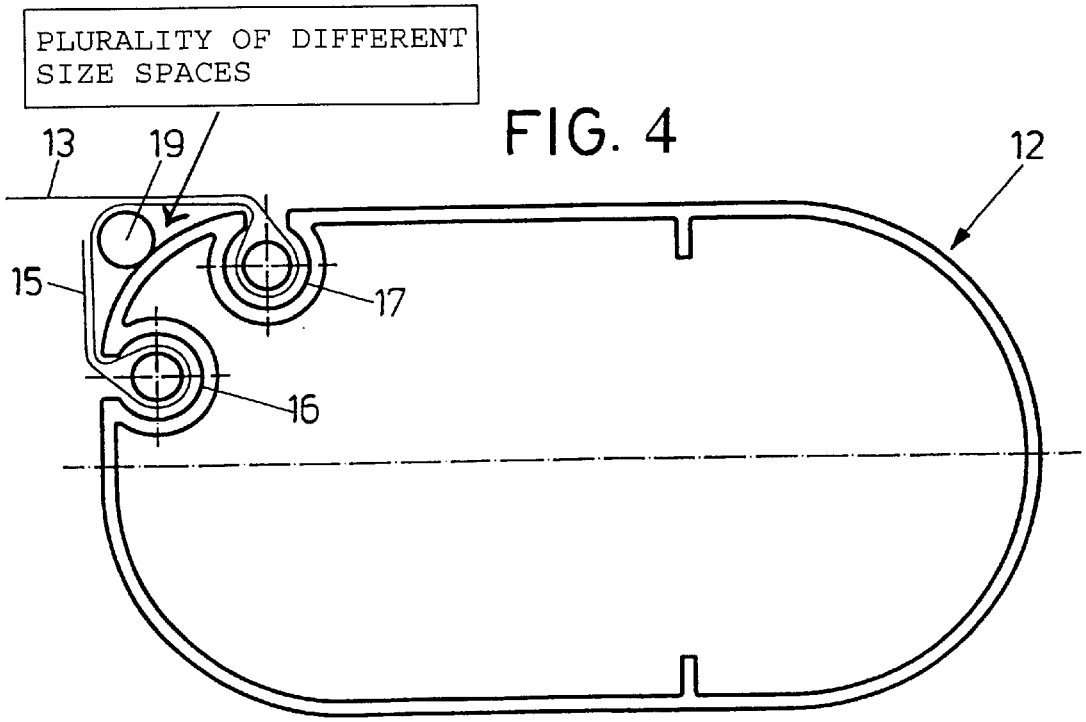
FIG. 4 is a corresponding illustration of the spacers.

FIG. 3 illustrates that a round, rod-type spacer 19 is inserted between, and parallel to, the two piping grooves 16, 17, effectively reducing the length of the fabric between the fabric shaft and the drop-out pipe 12 so that any sagging seam can be tightened in this way, there being no need of complicated manipulations as is the case in conventional awnings.

What is claimed is:

1. An awning comprising an awning fabric to be furled, and support structure for said awning fabric including a drop-out pipe (12) to which said fabric is attached by a first piping in a first piping groove, and a deflection arrangement adjacent said piping for increasing or reducing any free length of the fabric.

2. An awning according to claim 1, wherein the deflection arrangement comprises a second piping groove (17) having a second piping (18) therein.

3. An awning according to claim 2, further comprising a spacer (19) which extends radially away from the drop-out pipe (12) between said first piping and said second piping.

4. An awning according to claim 3, wherein the spacer (19) is located between the drop-out pipe (12) and the awning fabric (13) and applies tension to the fabric.

5. An awning according to claim 3, wherein a plurality of spacers (19) of varying size are provided for adjustment of a defined reduction in length.

6. A joint-arm awning comprising an awning fabric to be furled, and support structure for said awning fabric including a drop-out pipe adjacent to and supporting a front portion of said fabric, said drop-out pipe comprising first and second adjacent recesses, with said first recess containing a first piping and said second recess containing a second piping, said fabric having an end thereof attached to said drop-out pipe by extending into said first recess about said first piping and then out of said first recess and into said second recess and about said second piping.

7. An awning according to claim 6 further comprising at least one spacer between said fabric and said drop-out pipe, and between said first and second pipings.

* * * * *